US005681266A

United States Patent [19]

Lin

[11] Patent Number: 5,681,266

[45] Date of Patent: Oct. 28, 1997

[54] SOLE MASSAGER

[76] Inventor: Pin-Huang Lin, P.O. Box 82-144, Taipei, Taiwan

[21] Appl. No.: 623,114

[22] Filed: Mar. 28, 1996

[51] Int. Cl.[6] ..... A61H 7/00

[52] U.S. Cl. ..... 601/104; 601/103; 601/101; 601/28

[58] Field of Search ..... 601/27–29, 84, 601/97, 101, 103, 104, 100, 108, 111

[56] References Cited

U.S. PATENT DOCUMENTS

| | | | |
|---|---|---|---|
| 2,152,230 | 8/1939 | Bagnell | 601/104 |
| 2,186,105 | 5/1940 | Hall | 601/111 |
| 2,276,510 | 5/1942 | Newton | 601/111 |
| 4,682,771 | 7/1987 | Jean | 601/27 |
| 5,167,225 | 12/1992 | Cheng-I | 601/112 |

FOREIGN PATENT DOCUMENTS

| | | | |
|---|---|---|---|
| 372114 | 6/1990 | European Pat. Off. | 601/103 |
| 1623651 | 1/1991 | U.S.S.R. | 601/104 |

*Primary Examiner*—Robert A. Hafer
*Assistant Examiner*—Benjamin Koo
*Attorney, Agent, or Firm*—Alfred Lei

[57] ABSTRACT

A sole massager including a housing having a plurality of perforations, a base mounted on a bottom of the housing, a pressure regulating device installed on the base and having a plurality of sliders provided with a plurality of massaging pins aligned with the perforations of the housing, a plurality of acupoint selecting devices arranged into respective sliders, and a sole size adjusting device, whereby a user can control the sole massager to massage his sole as desired.

2 Claims, 11 Drawing Sheets

SOLE MASSAGER

BACKGROUND OF THE INVENTION

1. Field of the Invention

This invention is related to an improved sole massager.

2. Description of the Prior Art

It has been found that one's health would be fostered by massaging certain portions of his sole. Hence, there is a need for a sole massager which can accomplish this purpose. However, none of the sole massagers sold on the market is satisfactory in use.

Therefore, it is an object of the present invention to provide an improved sole massager which can obviate and mitigate the above-mentioned drawbacks.

SUMMARY OF THE INVENTION

This invention relates to an improved sole massager.

It is the primary object of the present invention to provide a sole massager which can be regulated in pressure applied to a user's sole.

It is another object of the present invention to provide a sole massager which can massage the desired acupoint of a user's sole.

It is still another object of the present invention to provide a sole massager which can be adjusted to adapt to soles of different sizes.

It is still another object of the present invention to provide a sole massager which is practical in use.

It is a further object of the present invention to provide a sole massager which is simple in construction.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
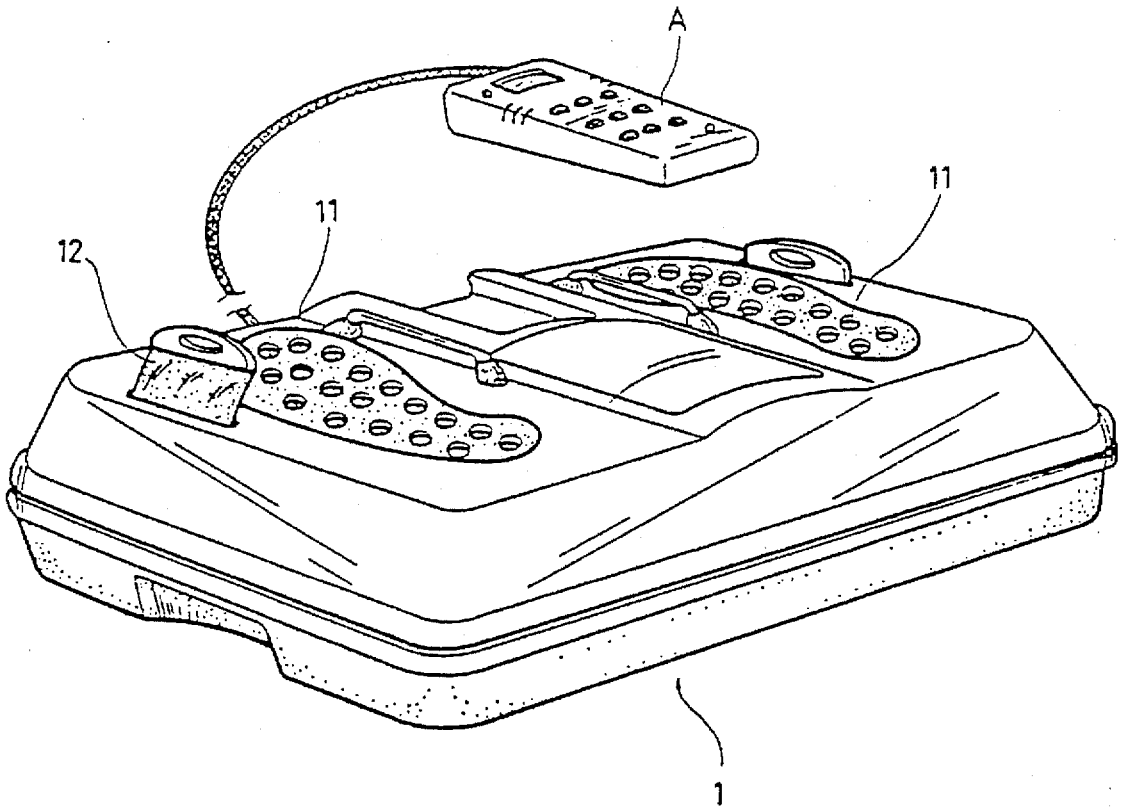
FIG. 1 is a perspective view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

With reference to the drawings and in particular to FIG. 1 thereof, the sole massager according to the present invention comprises a housing 1 in which are mounted a pressure regulating device, an acupoint selecting device and a sole size adjusting device. The housing 1 is formed with a plurality of perforations 11.

Figure 2:
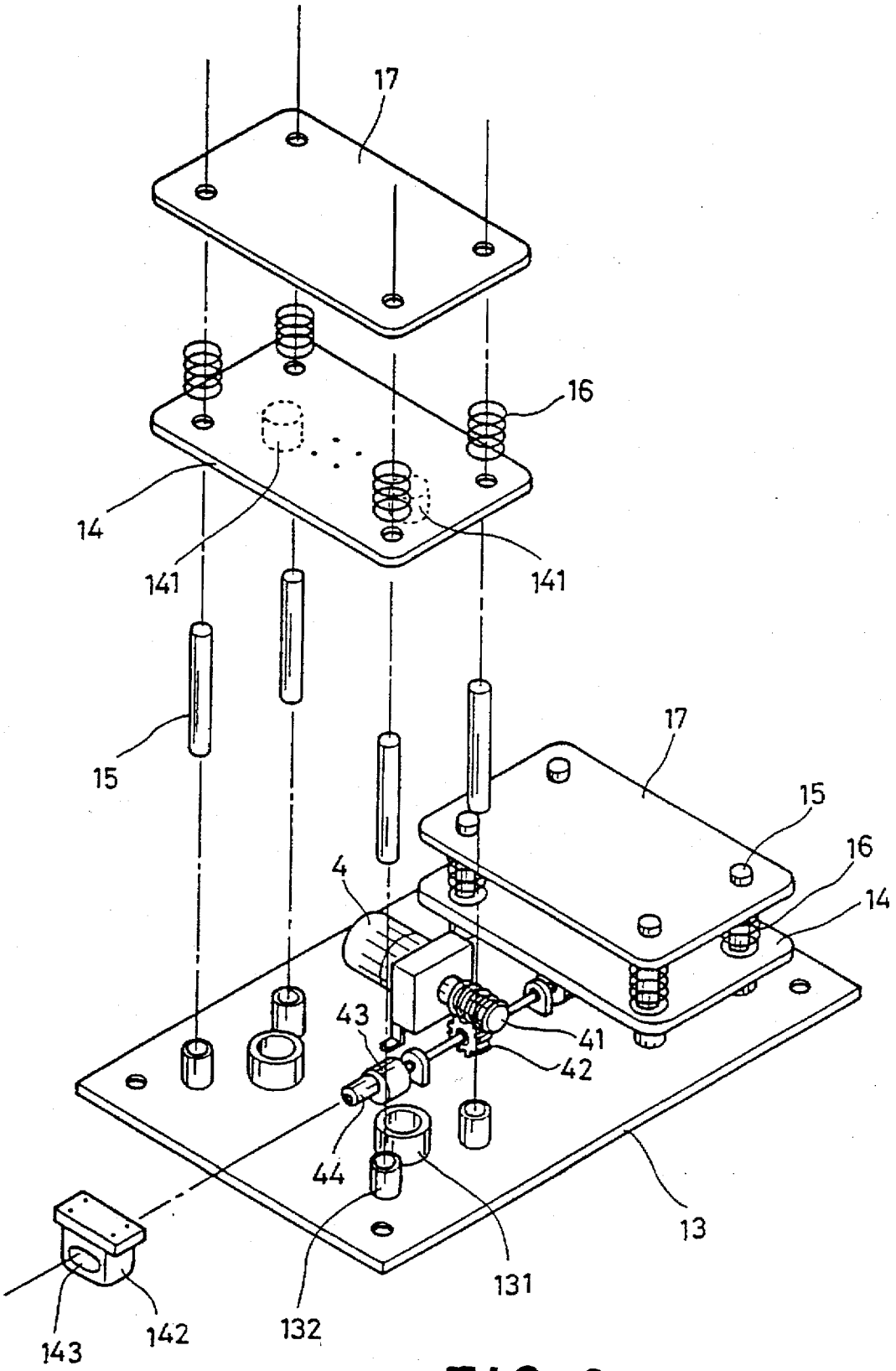
FIG. 2 is an exploded view of the pressure regulating device.
Figure 8:
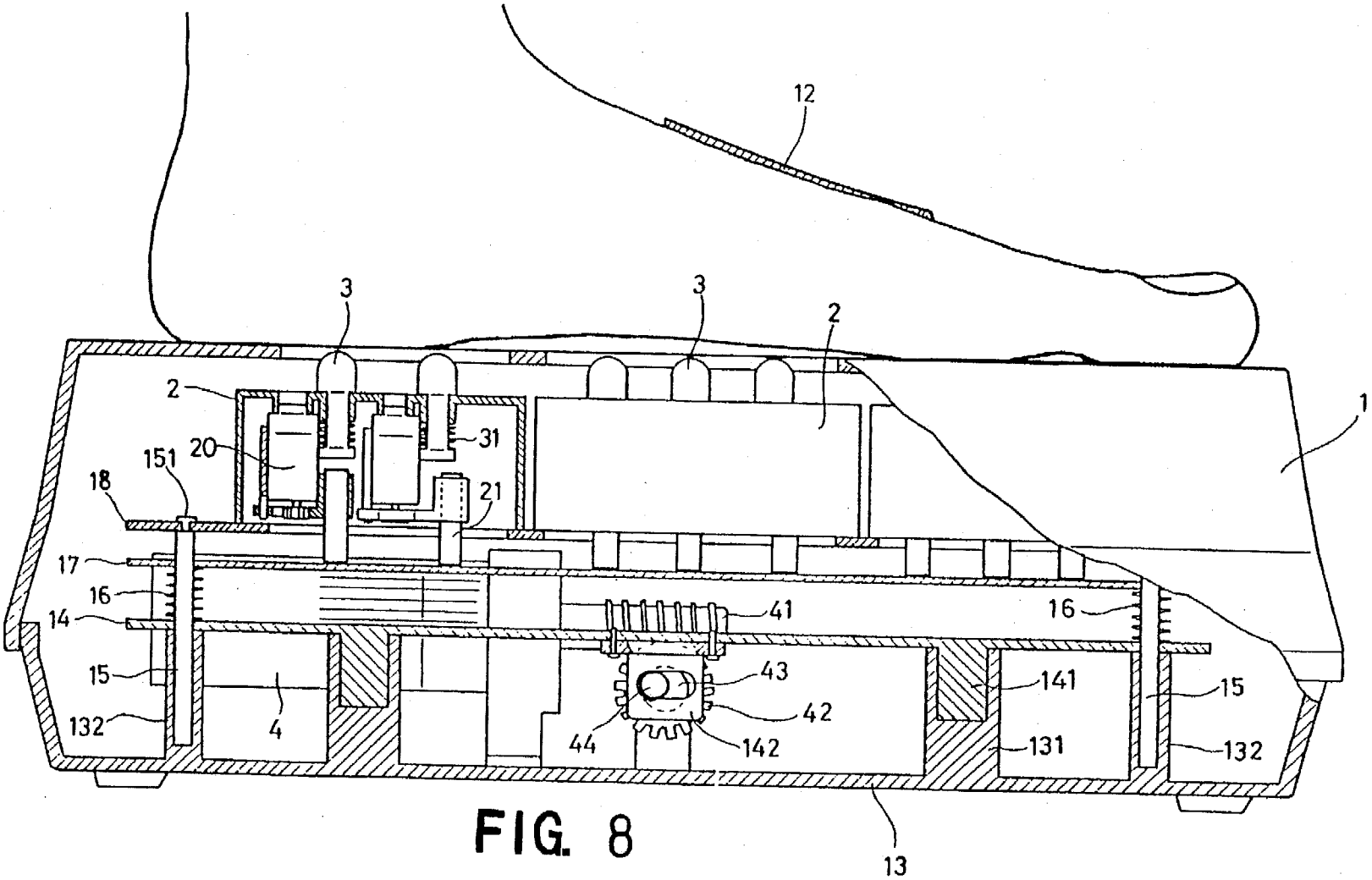
FIGS. 8 and 9 illustrate how the present invention works.

Referring to FIGS. 2 and 8, the pressure regulating device is mounted on the base 13 of the housing 1. The base 13 is provided with a plurality of large tubular portions 131 and small tubular portions 132. A lower plate 14 is mounted on the base 13, with its protuberances 141 at the bottom received in respective large tubular portions 13. Four pins 15 are inserted through the lower plate 14 into respective small tubular portions 132 thereby keeping the lower plate 14 in position. A spring 16 is fitted over each of the pins 15 and bears against the upper side of the lower plate 14. An upper plate 17 is disposed on the springs 16 with the pins 15 extending upwardly out of the four corners thereof. A fixing panel 18 is mounted on the upper ends of the pins 15 by four caps 151. A plurality of sliders 2 are installed on the fixing panel 18. The slider 2 is provided with a plurality of massaging pins 3 and push rods 21. The massaging pins 3 are aligned with respective perforations 11 of the housing 1. The push rods 21 extend downwardly through the fixing panel 18 to rest on the upper plate 17. A motor 4 is mounted on the base 13 between the two lower plates 14 and has an output axle connected with a worm rod 41. The worm rod 41 is connected to a worm gear 42 which is mounted on a shaft both ends of which are provided with a disk 43 having an eccentric pin 44 thereon. The eccentric pin 44 of the disk 43 extends into an elongated slot 143 of a block 142 which is fixedly mounted on the bottom side of the lower plate 14. Hence, when the motor 4 is turned on, the lower and upper plates 14 and 17 will be moved up and down.

Figure 3:
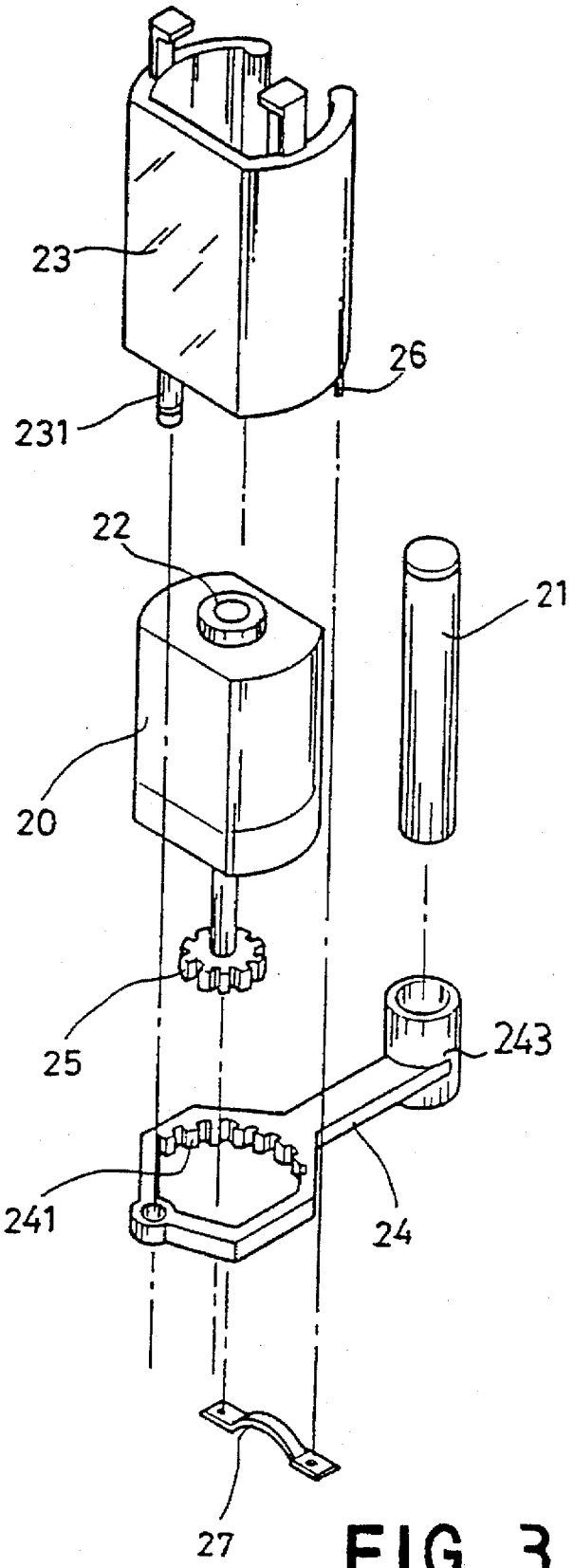
FIG. 3 is an exploded view of the acupoint selecting device.
Figure 4B:
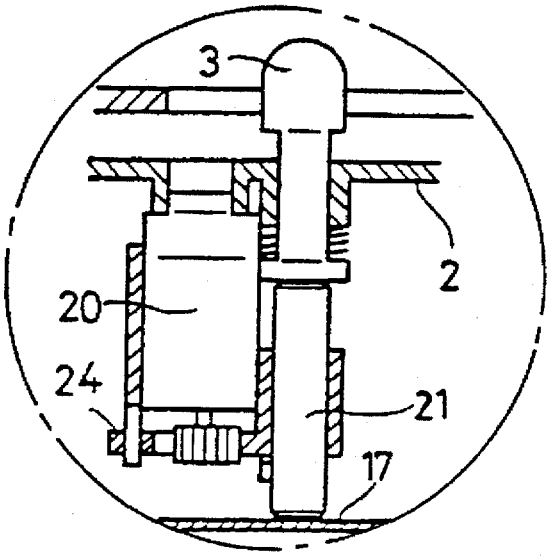
FIGS. 4A, 4B, 5A and 5B illustrate the working principles of the acupoint selecting device.
Figure 4A:
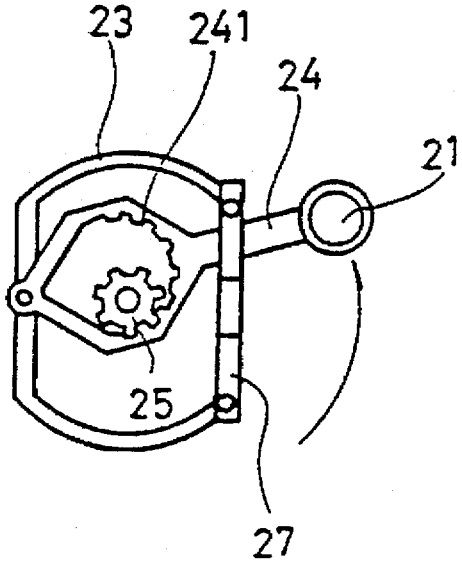
Figure 5B:
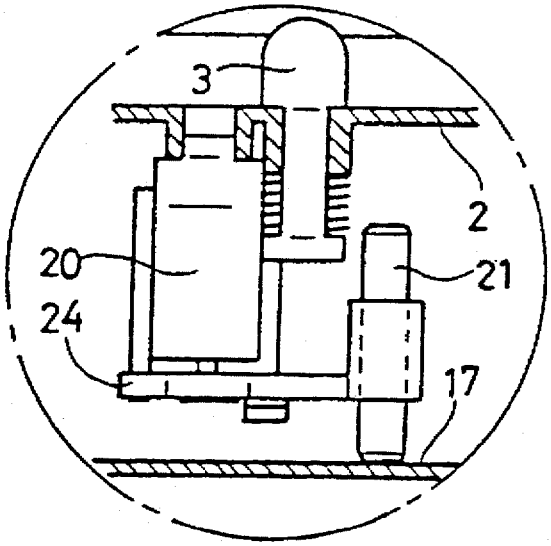
Figure 5A:
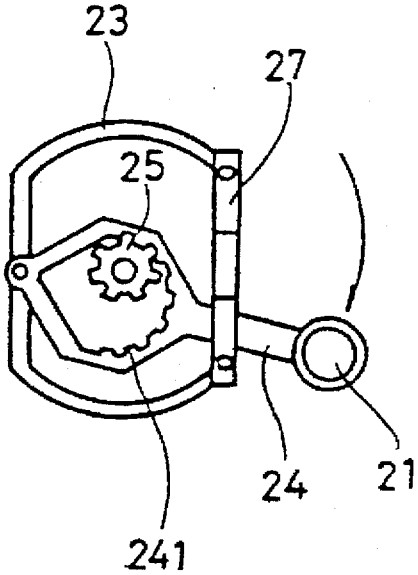

The acupoint selecting device includes a plurality of push rods 21 each being rotatably fitted in a tubular end 243 of an oscillating arm 24 (see FIGS. 3, 4A, 4B, 5A and 5B. The other end of the oscillating arm 24 is formed with a plurality of internal threads 241 adapted to engage with a gear 25 fixedly mounted on an output shaft of a motor 20. The motor 20 is enclosed within a casing 23 which has a downwardly depending pin 231 pivotally connected to the other end of the oscillating arm 24. A resilient member 27 is engaged with the projections 26 (only one is shown in FIG. 3) at the lower end of the casing 23 for steadying the motion of the oscillating arm 24. The oscillating arm 24 may be rotated so that the push rod 21 is aligned or not aligned with the massaging pin 3.

Figure 6:
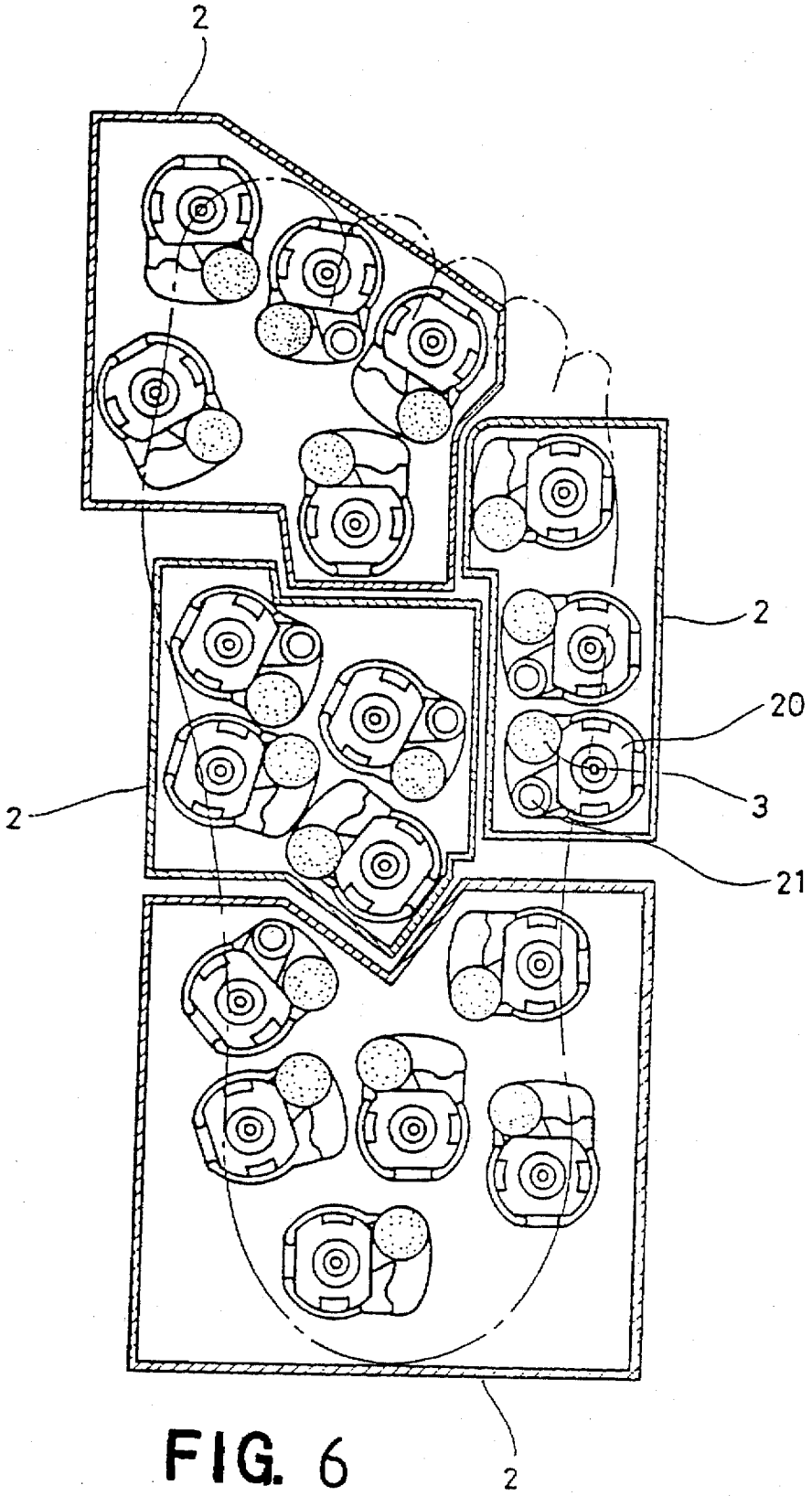
FIG. 6 is a sectional view showing the location of the sliders.
Figure 7:
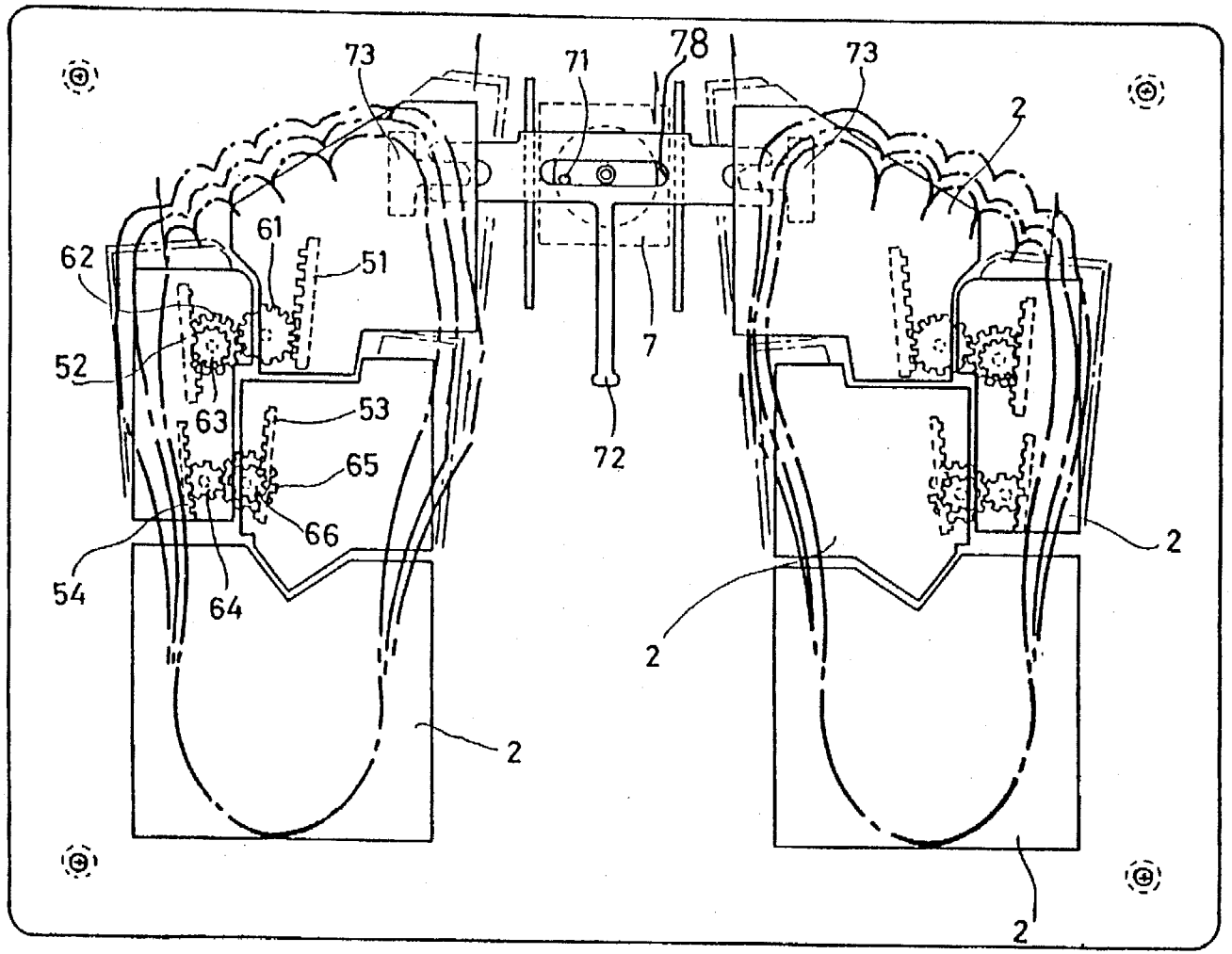
FIG. 7 illustrates the structure of the sole size adjusting device.

FIGS. 6 and 7 illustrate the sole size adjusting device. As shown, toothed racks 51, 52, 53 and 54 are mounted under the sliders 2 and are engaged with a gear 61, two gears 62 and 63, two gears 65 and 66, and a gear 64, respectively. The gear 61 is engaged with the gear 62, while the gear 65 engaged with the gear 64. All the gears are installed on the fixing panel 18. A motor 7 is arranged within the housing and has an eccentric axle 71 fitted in an elongated slot 78 of a sliding seat 72. Each end of the sliding seat 72 has a notch engaged with a block 73 which is fixedly mounted on the slider 2 so that when the eccentric axle 71 is turned by the motor 7, the sliders 2 will be moved outward or inward to adapt to soles of different sizes.

Figure 9:
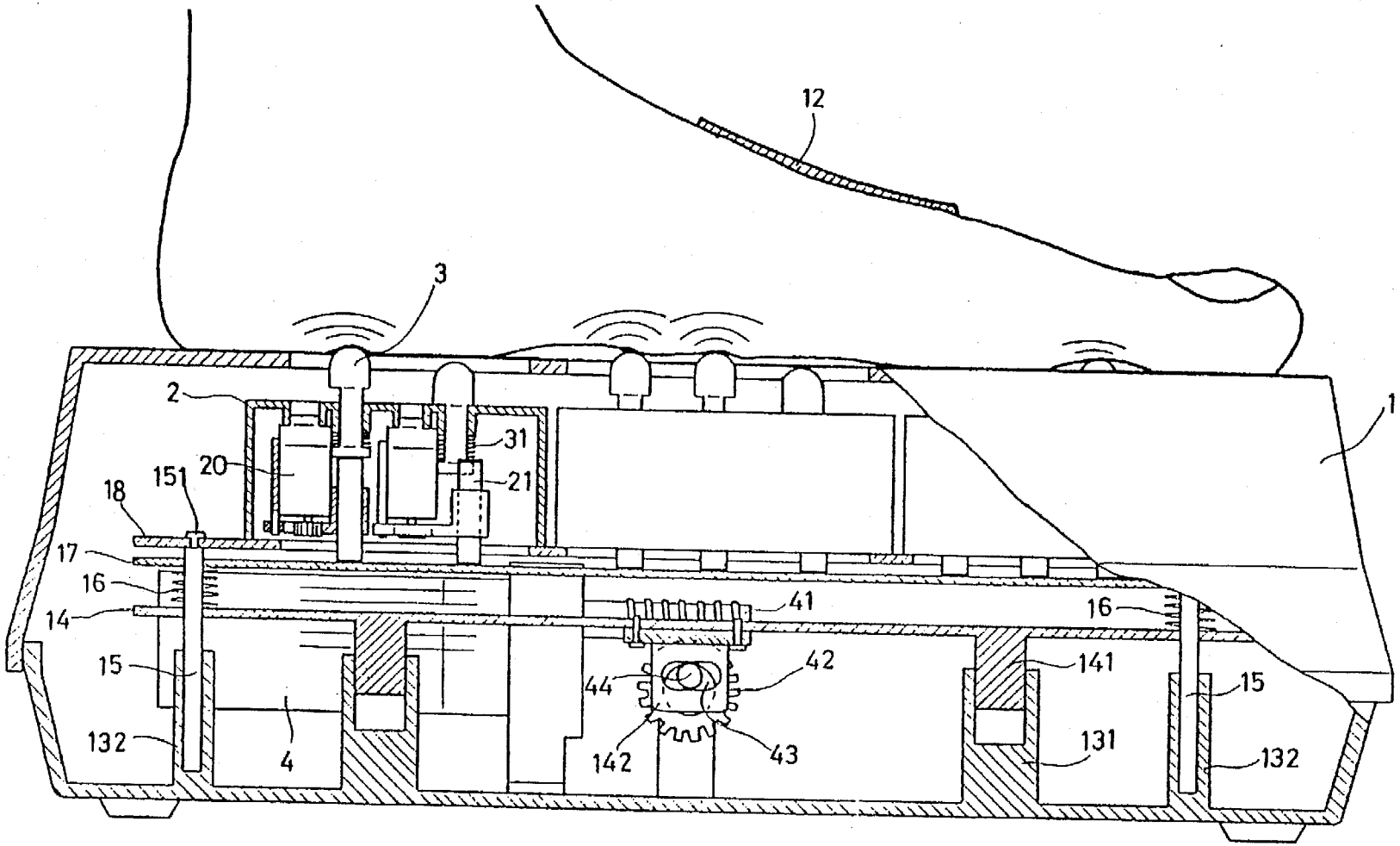
Figure 10:
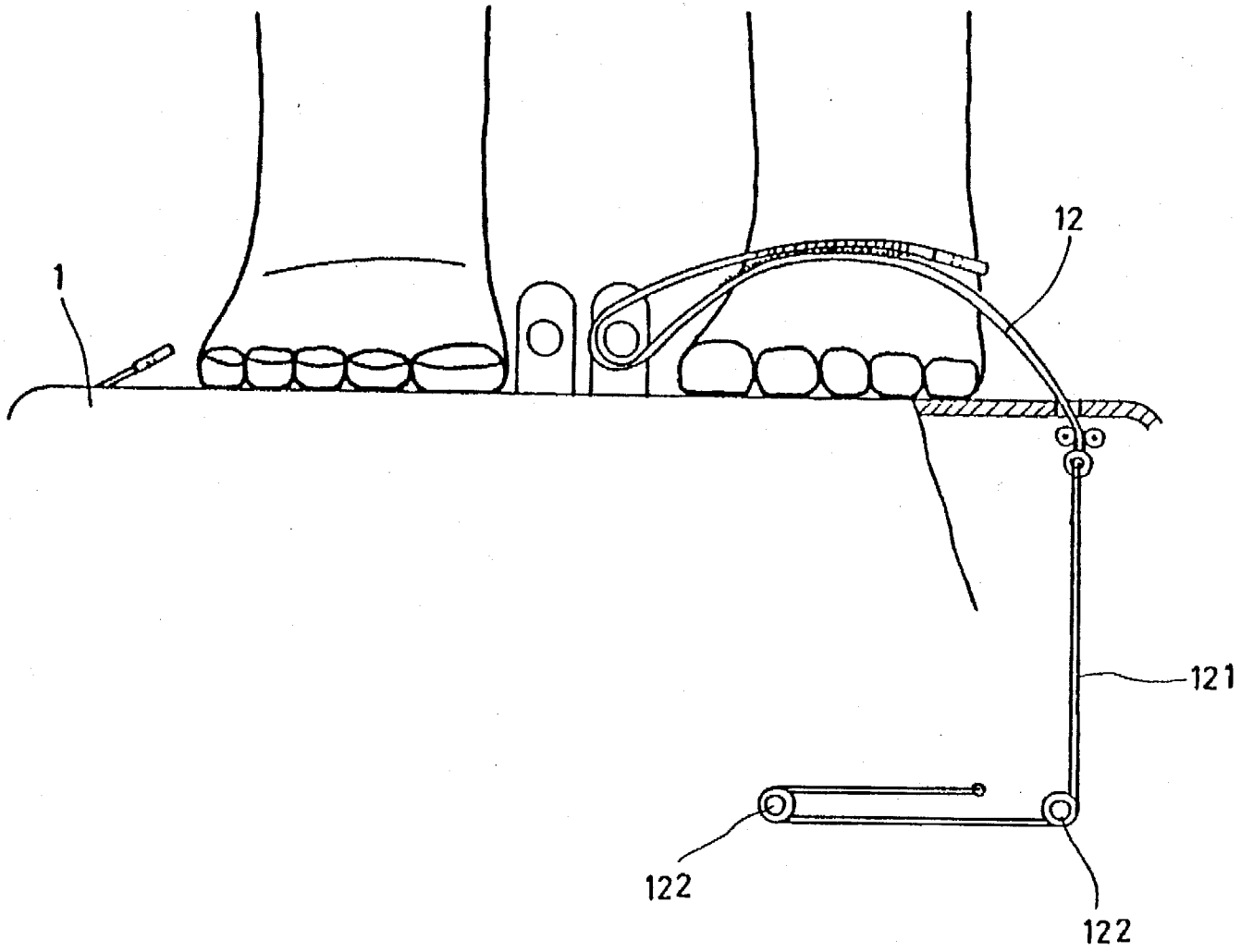
FIG. 10 illustrate how to use the strap to keep the foot in position.

A pair of straps 12 extend out of the housing 1, which are connected with a resilient cable 121 guided by rollers 122 (see FIGS. 9 and 10). Thus, the feet of an user may be kept in position by the straps 12.

Figure 11:
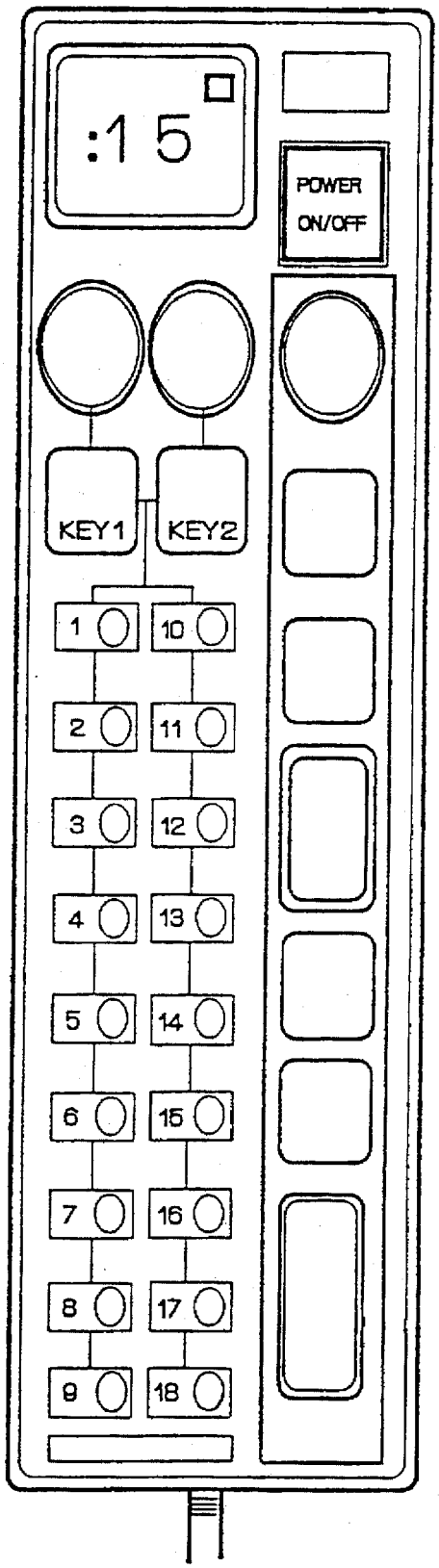
FIG. 11 is a front view of the controller.
Figure 12:
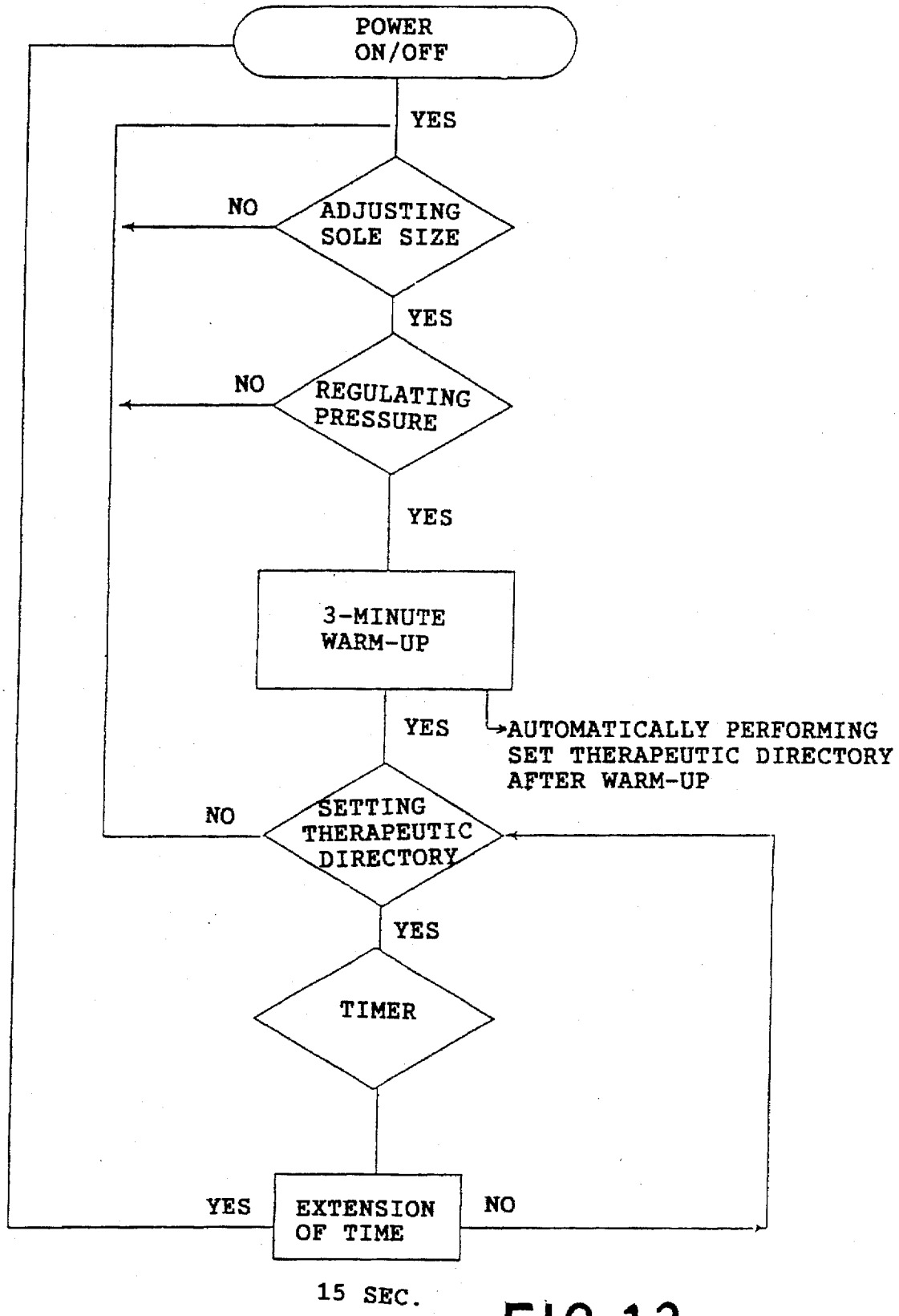
FIG. 12 is a flow chart of the present invention.

FIG. 11 illustrates a controller A which is used for controlling the pressure regulating device, the acupoint selecting device and the sole size adjusting device. FIG. 12 is a flow chart of the present invention, which illustrates how the present invention is controlled.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A sole massager comprising:

a housing having a plurality of perforations;

a base mounted on a bottom of said housing and provided with a plurality of tubular portions thereon;

a pressure regulating device installed on said base and including two lower plates supported by said tubular portions, a plurality of resilient means disposed on said lower plates, two upper plates supported by said resilient means, a first motor mounted on the base between said two lower plates and having an output axle connected with a worm rod, said worm rod being connected to a worm gear mounted on a shaft both ends of which are provided with a disk having an eccentric pin thereon, said eccentric pin extending into an elongated slot of a block fixedly arranged on a bottom side of respective lower plate, and a plurality of sliders provided with a plurality of massaging pins aligned with said perforations;

a plurality of acupoint selecting devices arranged into respective sliders and each including a plurality of push rods each rotatably fitted in a tubular portion formed at a first end of an oscillating arm, a second end of said oscillating arm being formed with a plurality of internal threads adapted to engage with a gear fixedly mounted on an output shaft of a second motor, said second motor being enclosed within a casing having a downwardly depending pin pivotally connected to the second end of said oscillating arms; and a sole size adjusting device including a third motor connected with an eccentric pin fitted in a slot of a sliding seat, said sliding seat being provided at both ends with a notch engaged a block which is fixedly mounted on said slider.

2. The sole massager as claimed in claim 1, further comprising two resilient straps extending out of said housing.

* * * * *